United States Patent [19]

Lucik

[11] 4,284,366

[45] Aug. 18, 1981

[54] ELASTOMERIC COMPOSITE PAVEMENT

[75] Inventor: Dennis M. Lucik, Middlefield, Ohio

[73] Assignee: The Johnson Rubber Company, Burton Township, Geauga County, Ohio

[21] Appl. No.: 47,500

[22] Filed: Jun. 11, 1979

[51] Int. Cl.[3] ..... E01C 5/22

[52] U.S. Cl. ..... 404/44; 404/82; 52/612; 264/313

[58] Field of Search ..... 404/44, 32, 33, 19, 404/20, 17, 72, 71, 82; 14/16.1; 267/141.1; 52/596, 612; 264/DIG. 63, DIG. 61, DIG. 31

[56] References Cited

U.S. PATENT DOCUMENTS

| | | | |
|---|---|---|---|
| 451,466 | 5/1891 | Drake . | |
| 1,300,591 | 4/1919 | Ebinger | 404/44 X |
| 1,474,481 | 11/1923 | King | 404/19 |
| 1,516,890 | 11/1924 | Pochin | 404/44X |
| 1,629,487 | 5/1927 | Draullette | 404/44 X |
| 1,728,991 | 9/1929 | Draullette | 404/44 X |
| 1,885,720 | 11/1932 | Hewett | 404/44 |
| 1,925,460 | 9/1933 | Pegran | 404/44 X |
| 2,317,963 | 4/1943 | Bashore | 404/19 X |
| 3,272,098 | 9/1966 | Buchholtz . | |
| 3,334,555 | 8/1967 | Nagin . | |
| 3,441,457 | 4/1969 | Regnaud | 156/71 |
| 3,797,951 | 3/1974 | Zichner | 404/19 |

*Primary Examiner*—Nile C. Byers, Jr.

*Attorney, Agent, or Firm*—Pearne, Gordon, Sessions, McCoy & Granger

[57] ABSTRACT

A premium paving unit of elastomeric binder material and friction aggregate formed by a molding method which results in an ideal distribution of the aggregate in the binder wherein the aggregate is exposed at a wear face of the unit, has a preferential orientation with the wear face, and is substantially uniformly distributed throughout the remainder of the unit.

10 Claims, 7 Drawing Figures

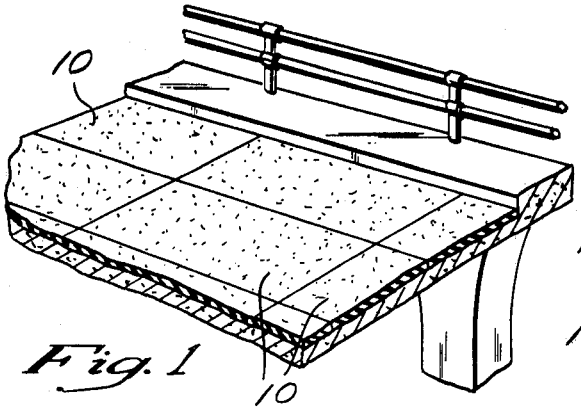
Fig. 1
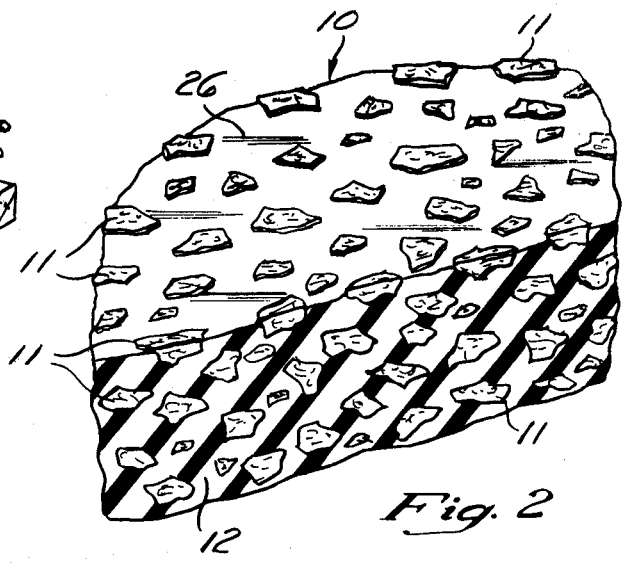
Fig. 2
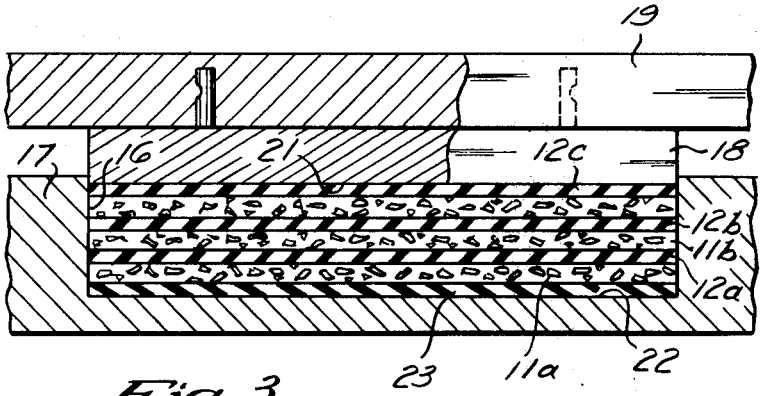
Fig. 3
Fig. 4
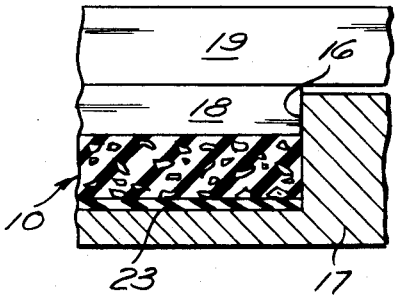
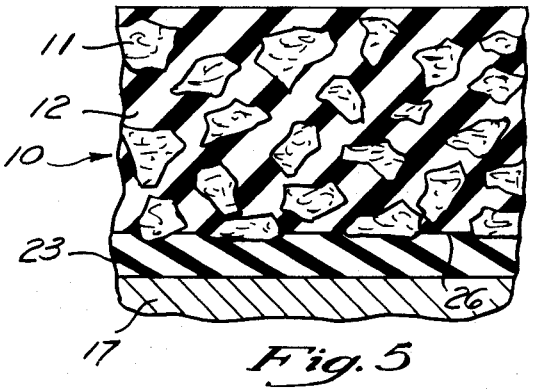
Fig. 5
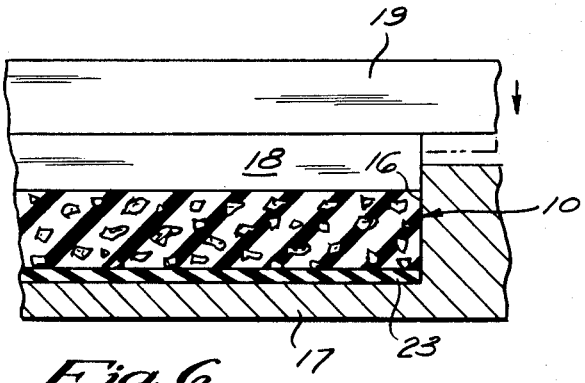
Fig. 6
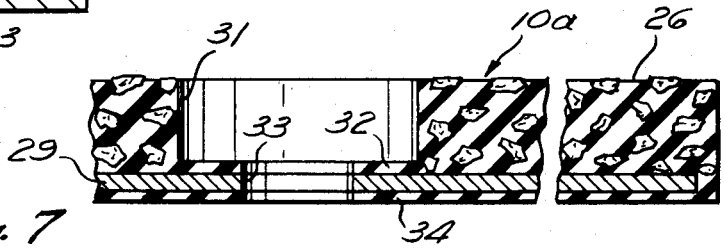
Fig. 7

ELASTOMERIC COMPOSITE PAVEMENT

BACKGROUND OF THE INVENTION

The invention relates to the manufacture of paving units particularly suited for use in applications which are of an exacting nature, such as in bridge decks.

PRIOR ART

The great outdoors presents a hostile environment for road surfaces for a variety of reasons, including constant thermal changes, freeze-thaw cycles, chemical precipitation, and micro-ecological attack. These environmental factors, individually and in combination, are known to cause premature deterioration of common paving materials such as concrete and asphalt. Added to these destructive phenomena in which nature plays an exclusive or principal part in the inevitably destructive practice of de-icing conventional pavements with chlorides of sodium or calcium. Economic losses resulting from pavement deterioration under thermal, chemical and biological attack are particularly high where bridge structures are concerned. Since even limited failure of a bridge structure can endanger life and property, it is imperative that deterioration be avoided whenever practical. The pavement of a bridge is often stressed by static design to an extent much higher than that of overland pavement, so that local mechanical failure, due to deterioration, tends to accelerate. A bridge pavement, further, may be stressed beyond critical limits where provision for thermal expansion and contraction is dysfunctional, due to improper maintenance or design. Where deterioration of a bridge surface is found to exist, remedies invariably involve high economic costs. Ordinarily, there is no convenient alternate route available to traffic on a bridge, so that often repairs must be made while traffic is maintained in some manner. Erection and maintenance of safety barriers is but one example of auxiliary costs incurred in bridge maintenance and repair. Where the bridge surface is a part of a reinforced or stressed concrete deck, local repairs are made difficult by the presence of reinforcement members. All of these considerations demonstrate a need for a durable road pavement capable of withstanding the rigors imposed by nature and man.

In a variety of known processes for producing pavement, friction developing aggregates are mixed with a settable binder to form a composite material which is then molded, cast, or rolled into final form before full setting of the binder. As a result of the mixing process, the aggregate particles are ordinarily completely covered or coated with the binder. Another known process for producing a pavement surface includes the spreading, coating, or other distribution of a binder or adhesive followed by the spreading, e.g., sprinkling, over such binder of an aggregate. The aggregate is allowed to settle into and become bonded to the adhesive or binder. To provide a wear surface in which the aggregate is exposed in the mixed binder/aggregate methods, it has been considered necessary to mechanically or otherwise remove any coating of the binder on the aggregate after setting of the binder. The "sprinkling" method does not afford precise control with respect to the degree aggregate particles are enveloped by the binder, or does this method afford a control of the final orientation of particles in the binder or matrix.

SUMMARY OF THE INVENTION

The invention provides a molded paving unit formed as a composite of resilient base material and a friction aggregate. In a final molded condition, the particles of the aggregate are disposed in the base material throughout the thickness of the paving unit while being advantageously exposed at a wear surface of the unit. In accordance with the invention, the paving unit is produced by molding its wear surface in contact with a compliant mold wall. This compliant wall has been found to effectively exclude binder material from interfacial areas between the wall and aggregate faces immediately adjacent the wall. The result is that a negligible film of binder material, if any, covers the aggregate faces at the wear surface. This binder-excluding function of the compliant wall avoids or minimizes subsequent steps of abrading or otherwise removing any binder coating, which would reduce the friction characteristics of the aggregate.

Further, it has been discovered that interaction between the compliant molding wall and aggregate particles tends to align the flat faces of the particles into the plane of the compliant wall and ultimately the wear surface of the paving unit so that the particles contribute a relatively large fraction of the molded wear face and whereby the friction characteristics of the particles are immediately evident in the finished molded condition of the paving unit.

Additionally, the compliant mold wall compresses at individual locations of contact with the aggregate particles, with the result that the wear face of the paving unit is textured by slight protrusion of areas of the outermost particles from the main body of the binder material. This textured surface advantageously contributes to the overall friction coefficient of the wear face.

A paving unit manufactured according to the invention is especially suited for applications subjected to adverse environmental and service conditions, such as bridge decks, and other pavement areas that warrant a premium paving surface. The disclosed paving unit is highly resistant to wear and deterioration under high traffic, widely varying thermal conditions, and chemical attack.

BRIEF DESCRIPTION OF THE DRAWING

FIG. 1 is a fragmentary, schematic view of a bridge deck representing a suitable application for a paving unit constructed in accordance with the invention;

FIG. 2 is a fragmentary, perspective view of a portion of a paving unit constructed in accordance with the invention;

FIG. 3 is a schematic view of a mold cavity charged with elastomeric binder material and friction aggregate;

FIG. 4 is a schematic view of the mold charge of FIG. 3 under compression;

FIG. 5 is an enlarged, fragmentary, cross sectional view of a portion of the mold cavity and charge of FIG. 4 under a state of compression during a molding cycle;

FIG. 6 is a schematic view similar to FIG. 3, illustrating a charge of premixed elastomeric binder material and friction aggregate; and FIG. 7 is a cross sectional view of a paving unit constructed in accordance with the invention in a form suitable for mechanical attachment to an underlying support structure.

DESCRIPTION OF THE PREFERRED EMBODIMENTS

There is represented in FIG. 2 a portion of a paving unit 10 which, in its entirety, by way of example, may have dimensions of 3′×6′ and a thickness of 1½″. By assembling a plurality of such units 10 into abutting relation, a good pavement such as the bridge deck of FIG. 1 may be constructed. A paving unit 10 principally comprises particles of a friction aggregate 11 and an elastomeric binder or base material 12. The particles of aggregate 11 are conveniently formed of granite or quartzite chips, but may be of any other suitable stone or like material of, for example, ⅜″ nominal or smaller particle size. Preferably, as illustrated, the friction particles are crystalline in nature so that their surface affords flat faces of an irregular, non-spheroid configuration. An example of suitable elastomeric binder material 12 is EPDM (a terpolymer elastomer made from ethylene-propylene diene monomer), although other compounds, such as neoprene, natural rubber, and like material, may be used. The friction aggregate 11 and elastomeric binder 12 are mixed in a ratio of approximately 50:50 by weight and, where possible, with a greater percent of aggregate up to, for example, 60 parts aggregate to 40 parts binder by weight.

In one method of fabricating the paving unit 10, referring to FIG. 3, a mold cavity 16 is provided having dimensions corresponding to the planar dimensions desired in a final paving unit product (e.g., a rectangle of 3′ by 6′). The depth of the mold cavity is preferably somewhat greater than the final thickness of the paving unit 10 so that extra volume taken up by air space around aggregate particles is accommodated in the cavity. The mold cavity 16 is formed by a mold bottom plate 17 secured to a bed (not shown) of a conventional compression molding machine. A top plate 18 is carried on a ram of the molding machine so that it can be forcibly lowered against the mold bottom plate 17 or raised as desired. A pressure plate 19 is fixed to the top plate 18 and is dimensioned to fit into and close off the mold cavity 16.

The mold cavity 16 is filled with the friction aggregate and elastomeric binder components by laying in alternate layers of aggregate particles 11 and elastomeric binder material 12. Preferably, the aggregate 11 is precoated with a suitable commercially available adhesive film compatible with the binder and aggregate to promote a strong bond with the binder material 12. Where the elastomeric binder material is a thermosetting material, such as EPDM, the binder material is provided in the layers of FIG. 3 in an uncured state. In a typical example, the uncured, elastomeric layers or sheets are three in number and are ⅜″ thick. The friction aggregate 11 is likewise provided in three layers, each of a thickness suitable for achieving the desired ratio of aggregate-to-binder material, e.g., 50:50 by weight.

It will be appreciated that a face 21 of the pressure plate 19 and a bottom face 22 of the cavity 16 are coextensive with the major faces of the final configuration of a paving unit 10. At one of these major mold cavity faces, in the illustrated case, at the bottom face 22 of the mold cavity 16, there is provided a compliant wall 23. It will be understood that, alternatively, the compliant wall may be provided on the pressure plate face 21. The remaining surfaces of the mold cavity 16 and the pressure plate 19 are conveniently formed of steel or other suitable rigid structural material.

The compliant wall 23 is formed of a deformable solid material and is preferably at least somewhat resilient with surface characteristics affording a satisfactory release from the selected binder material. A suitable presently preferred material is a sheet of Teflon of a thickness, for example, of ¼ inch. This compliant Teflon pad or sheet exhibits favorable release properties, and has a hardness well suited for practice of the present invention. Other compliant solid materials contemplated for substitution of the Teflon material of the compliant wall 23 include cured rubber, linoleum, cardboard, and the like. The particular compliant material used is selected on the basis of performance, cost, durability and availability. Alternate layers of friction aggregate 11 and elastomeric binder material 12 are manually or automatically laid into the cavity 16 with the layer in contact with the compliant wall 23 preferably being a layer of aggregate. Where the layers of elastomeric material are of uncured rubber, such as EPDM, the mold cavity surfaces are heated, preferably by maintaining the mold bottom plate 17 at or near a constant temperature according to conventional rubber molding practice. Upon extension of the ram, the pressure plate 19 is brought into contact with the upper or outermost layer of elastomeric binder material 12*c* to close the mold and compress the aggregate and binder materials 11 and 12. The plate 19 is subjected to sufficient force and displacement from its position in FIG. 3 to that of FIG. 4 to cause the elastomeric layers 12*a–c* and aggregate layers 11*a–c* to flow and cross-migrate into one another. The mold cavity 16 is held closed by the pressure plate 19 for a period of time to sufficiently cure or set the elastomeric material 12. Before this elastomeric material finally sets, it may be found necessary to "bump" the mold contents by slightly raising the ram and then returning it to an extended compressing condition. This allows the material in the cavity 16 to relax, permits any trapped gases or solvents to escape, and causes realignment of individual aggregate particles among themselves in a compact fashion. After sufficient material migration and setting of the binder material, the mold top plate 18 and pressure plate 19 are retracted with the ram to open the mold cavity 16 and permit removal of the paving unit 10. Where EPDM is used as the binder material 12, the mold cavity is heated to around 320° F. Approximately at this temperature, with suitable agents such as carbon black, lubricants, activators, accelerators, vulcanizing agents, plasticizers, and other agents, added as required in accordance with conventional molding practice, the uncured EPDM has a viscosity as measured on a Monsanto oscillating disc rheometer of about 3 inch-pounds. In general terms, this viscosity is approximately the consistency of tar when in a workable state. The pressure generated in the mold cavity 16 during the molding cycle is about 800 to 1000 psi.

Surprisingly, it has been found that the aggregate particles 11 substantially uniformly migrate into the layers of elastomeric binder material 12, and vice versa. Even more significantly, it has been discovered, unexpectedly, that the compliant wall 23 produces unique physical effects on the associated face of the paving unit in contact with it.

The physical effects on the associated face of the paving unit 10, employed ultimately as a wear surface 26 directly or substantially as molded, include: (1) exlusion or minimization of elastomeric binder material on surfaces of the friction aggregate at their faces of contact with the compliant wall, (2) slight protrusion of the aggregate particles at the wear surface above surrounding areas of the elastomeric binder material, and (3) alignment of facets or flats of the outermost friction particles with the plane of the compliant wall 23.

The exclusion of the elastomeric binder material from the outer faces of the outermost friction particles avoids the necessity of later removal by mechanical or other means of a skin of elastomeric binder material from the friction particles, which would otherwise inhibit their performance. It is not understood how this phenomenon or mechanism of exclusion of the binder material from the outermost facets or faces of the outer friction particles is achieved. Protrusion of the outermost friction particles from the surrounding elastomeric binder material directly contributes to the frictional character of the wear surface 26 by promoting contact with the friction particles and limiting contact with the lower lying areas of the elastomeric binder material 12. This permanent effect illustrated in FIG. 5 and developed by the conditions and materials in the mold cavity during the molding cycle is the apparent result of local deformation and indentation of the compliant wall 23 at points of contact with the outermost friction particles or aggregate 11. Alignment of the outer facets or faces of the friction particles with the plane of the compliant wall 23 maximizes the area presented by the outermost friction particles to further augment their frictional characteristics. Inspection of FIG. 1 reveals that the friction particles at the wear surface 26 are fully embedded in the binder so that there is little risk that they will be released before being significantly worn away and, accordingly, a long service life will be achieved. Consideration of FIG. 1 also leads to the realization that the friction particles are firmly locked into their fixed orientation by virtue of their irregular shape where they are crystalline in nature. That is, a crystalline friction particle exhibits less of a tendency to roll out of a pocket which the elastomeric material forms about it when compared to the tendency of more spherical particles.

FIG. 6 schematically represents a modified method of manufacturing a paving unit in accordance with the invention. In this modified method, the friction aggregate 11 and elastomeric binder material 12 are premixed prior to introduction into the mold cavity 16. The materials for use as friction aggregate and elastomeric binder material can be the same as that described above in connection with FIGS. 3 and 4. The same numerals have been used to designate elements of the molding apparatus as those used in connection with FIGS. 3 and 4. Again, in the mold cavity 16 there is disposed a compliant wall 23. The mold cavity 16 is charged with the preblended or premixed friction aggregate and elastomeric binder material and the top plate 18 and pressure plate 19 are lowered to compress these components into a molded paving unit.

It has been discovered, surprisingly, that even where the components of friction aggregate and elastomeric base material 11 and 12 are preblended before introduction into the mold cavity, the compliant wall produces the enumerated physical effects on the wear surface 26 of the paving unit. As mentioned above, these physical effects include the exclusion or minimization of any coating of binder material on the outermost faces of the friction particles, projection of the friction articles above the main body of elastomeric binder material and parallel alignment of the outermost faces or facets of the friction particles with the plane of the compliant wall 23. The method suggested in FIG. 6 of premixing the friction aggregate with the elastomeric binder material has the advantage over the method suggested in FIGS. 3 and 4 of reducing labor or complexity of automatic feeding by avoiding the necessity of laying up discrete layers of binder material and friction aggregate. However, with the preblending method of FIG. 6, there may occur the disadvantage of the existence of a thin film of elastomeric binder material covering the outermost faces of the friction particles where such binder material is not completely excluded from the interfaces between these outermost particles and the compliant wall 23. Where this thin film occurs and it is considered to be objectionable, minimal exposure to wire brushing or other stripping process will satisfactorily remove the coating with a minimum of effort.

With reference to FIG. 7, a paving unit **10*a* is molded with a stiffening and anchoring plate 29 of steel or other rigid structural material. The steel plate, ideally, is assembled into the mold cavity 16 along with the other previously described components of friction aggregate 11 and elastomeric binder material 12. Any conventional mechanical expedient may be used to space or hold the stiffening plate 29 in the mold cavity 16 from the compliant wall 23 and the eventual final wear face 26. Desirably, the reinforcing plate 29 is completely embedded within the paving unit 10*a* so that the elastomeric material 12 coats and encapsulates the plate to protect it from corrosive environments. It will be understood that the stiffening plate 29 is slightly smaller in its rectangular planar dimensions than the paving unit 10*a* so that its edges, in addition to its major faces, are covered with binder material. A circular cavity 31 is formed in the paving block or unit 10*a* from the wear surface 26 down to a thin film of elastomeric material, designated 32. A bore 33 extends through this thin film, the stiffening plate 29 and a lower layer of elastomeric film designated 34 at the bottom of the paving unit 10*a* covering the stiffening plate 29. It will be understood that a typical paving unit 10*a* is provided with a plurality of such cavities and bores 31,33 spaced across its rectangular area. Bolts or other headed fasteners are assembled into the cavities and bores 31, 33 and secured to an underlying structure, such as a steel deck. Thereafter, the cavity 33** and head of a bolt can be sealed by pouring a thermosetting elastomer into this cavity upon installation of the paving unit in the field.

The disclosed paving units 10 and **10*a* are particularly suited for use in paving applications where a long service life is of high priority and where service conditions are particularly adverse. The disclosed paving unit is essentially immune to the types of chemical and microecological attack which have been found to be detrimental to more conventional pavement structures. Additionally, the disclosed paving unit is capable of exhibiting a high degree of resistance to high compressive strains without failure so that destructive thermal expansion and contraction effects are essentially eliminated. One suitable application for the disclosed paving unit is the bridge decking illustrated in FIG. 1**, where high mechanical compressive forces are often found to be destructive and where premature failure of the actual wear surface of a pavement can be extremely expensive to repair or replace. Besides use as the entire covering for a bridge deck, it is contemplated that the paving unit disclosed has high utility both in retrofitting and in original equipment installations at or immediately adjacent local expansion strips of bridge decks and like structures. The resistance to high compressive strains of the elastomeric paving unit makes it particularly suited for use in expansion joints intermediate lengths of conventional pavements of concrete or asphalt.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of making a paving unit comprising the steps of providing a closed mold cavity having dimensions generally corresponding to the dimensions of the finished paving unit, a major planar wall of the mold cavity being formed of compliant material, introducing friction aggregate and settable elastomeric binder material into the mold cavity, compressing the elastomeric binder material with the friction aggregate substantially uniformly dispersed therethrough against the compliant wall under suitable conditions of temperature and pressure to cause the aggregate particles immediately adjacent the compliant wall to locally embed themselves into the compliant wall and effectively exclude the elastomeric binder material from the zones of embedment of the aggregate particles in the compliant wall, allowing the elastomeric binder material to set in the mold, thereafter removing the molded unit from the mold cavity with the face of the unit which formerly contacted the compliant wall exhibiting a textured wear surface wherein the outermost aggregate particles of this face protrude slightly from adjacent areas of elastomeric binder material and the protruding areas of these outermost particles are substantially free of any coating of elastomeric binder material.

2. The method set forth in claim 1, wherein said friction aggregate particles are provided as generally crystalline formations, interaction of said compliant wall, friction particles and elastomeric binder materials under the aforesaid molding conditions causing planar facets of the crystalline particles to align with the plane of said compliant wall, whereby a relatively large percentage of the wear face of the paving unit is contributed by said planar facets.

3. A method of making a paving unit comprising the steps of laying up a layer of aggregate against a surface defining a plane in a manner wherein a portion of the aggregate is in direct surface-to-surface contact with said plane defining surface, flowing a settable elastomeric material into the interstices of the aggregate layer to an extent that substantially all of the volume of interstices is filled with such elastomeric binder material, said elastomeric binder material being caused to enter and fill the interstices in a manner which avoids significant disruption of the previously established surface-to-surface contact between said aggregate and said plane defining surface while areas of said plane defining surface not contacted by said aggregate are contacted by said settable material, allowing said settable material to set and thereafter removing the composite formed by said aggregate and binder material from said plane defining surface, said aggregate being selected of a material harder than the final hardness achieved by said settable material and providing frictional characteristics for said paving unit.

4. A method as set forth in claim 3, wherein said aggregate is selected from a crystalline material having planar surfaces.

5. A molded paving block comprising an elastomeric composite body of predetermined thickness, said body comprising an elastomeric base and aggregate material dispersed in the base, the distribution of the aggregate being substantially uniform throughout the thickness of the block, said block having a molded wear surface at its upper face, the wear surface having a substantial fraction of its area formed by aggregate surface areas substantially free of any covering of the elastomeric base material, the individual aggregate particles providing said free surface areas being retained in said base material by embedment therein, the wear surface having its area remaining from that formed by said free surface areas being formed by the elastomeric base as a result of molding against a compliant cavity wall, the elastomeric base being excluded from said free surface areas of the aggregate by the interaction of the compliant cavity wall, elastomeric material and aggregate during the molding process, said free surface areas of aggregate being slightly raised above the surface of the elastomeric material as a result of the impression of such free surface areas into the compliant wall during the molding process.

6. A paving block as set forth in claim 5, wherein said aggregate is a crystalline material, a major fraction of said free surface areas of said aggregate being composed of generally flat crystal faces as a result of a tendency of said individual aggregate particles to orient themselves in such a manner that such flat faces align with the compliant mold cavity wall under conditions existing during the molding process.

7. A paving block as set forth in claim 6, wherein the particles of aggregate are bonded to the elastomeric base material through the medium of an adhesive coating applied to said particles prior to their embedment in said base material.

8. A paving block as set forth in claim 7, wherein the height of said body is relatively small in comparison to its width and length.

9. A paving block as set forth in claim 8, including a stiffening plate entirely embedded within the elastomeric material of said block.

10. A paving unit as set forth in claim 9, wherein said stiffening plate includes means for fastening said paving block to an underlying structural member.

* * * * *

UNITED STATES PATENT AND TRADEMARK OFFICE

CERTIFICATE OF CORRECTION

PATENT NO. : 4,284,366

DATED : August 18, 1981

INVENTOR(S) : Dennis M. Lucik

It is certified that error appears in the above—identified patent and that said Letters Patent is hereby corrected as shown below:

In the first page of the patent listing the patent particulars, under the title, the addresses of the inventor and assignee are reversed. They should be as follows:

Inventor: Dennis M. Lucik, --Burton Township, Geauga County, Ohio--;

Assignee: The Johnson Rubber Company, --Middlefield, Ohio--;

Column 1, line 19, change "in" to --is--.

Signed and Sealed this

*Fifth* Day of *January 1982*

[SEAL]

*Attest:*

GERALD J. MOSSINGHOFF

*Attesting Officer*

*Commissioner of Patents and Trademarks*